US005100012A

United States Patent [19]

Pacelli, Jr.

[11] Patent Number: 5,100,012

[45] Date of Patent: Mar. 31, 1992

[54] FLEXIBLE CAP LINER

[75] Inventor: Joseph G. Pacelli, Jr., Greenwich, Conn.

[73] Assignee: Diamond Plastics & Design, Inc., Greenwich, Conn.

[21] Appl. No.: 779,764

[22] Filed: Oct. 21, 1991

[51] Int. Cl.[5] ..... B65D 53/02

[52] U.S. Cl. ..... 215/352; 215/228; 215/227; 215/341

[58] Field of Search ..... 215/227, 228, 274, 277, 215/341, 346, 352, 329, 230; 220/304

[56] References Cited

U.S. PATENT DOCUMENTS

| | | | |
|---|---|---|---|
| 843,670 | 2/1907 | Fenn | 215/352 |
| 1,882,278 | 10/1932 | Francyk | 215/346 X |
| 2,196,345 | 4/1940 | Taylor | 215/341 X |
| 3,064,844 | 11/1962 | Hoffmann | 215/352 X |
| 3,677,431 | 7/1972 | Westfall | 215/346 X |
| 3,838,785 | 10/1974 | Lancesseur | 215/251 |
| 3,896,974 | 7/1975 | McIntosh | 215/228 X |
| 3,977,557 | 8/1976 | Hazard | 215/274 |
| 4,177,905 | 12/1979 | Winchell et al. | 215/246 |
| 4,273,247 | 6/1981 | Earls | 215/228 |
| 4,487,325 | 12/1984 | Willingham | 215/307 |

*Primary Examiner*—Stephen P. Garbe
*Assistant Examiner*—Vanessa Caretto
*Attorney, Agent, or Firm*—Henderson & Sturm

[57] ABSTRACT

A flexible, distortable liner is provided for the cylindrical interior cavity of a cap for a container, especially in the field of relatively small containers such as used for toiletries and the like, the purpose of the liner being to accommodate discrepancies between the neck of the container and the friction fit of the cap. The liner is essentially an annular wall fitting the interior of the cap but having alternated wall portions of reduced thickness compared to interspaced wall portions of greater thickness, the latter having outer arcuate surfaces tightly fitting the cap cavity and the former lying in radially spaced relation to the cap cavity so as to impart greater flexibility to the liner.

12 Claims, 2 Drawing Sheets

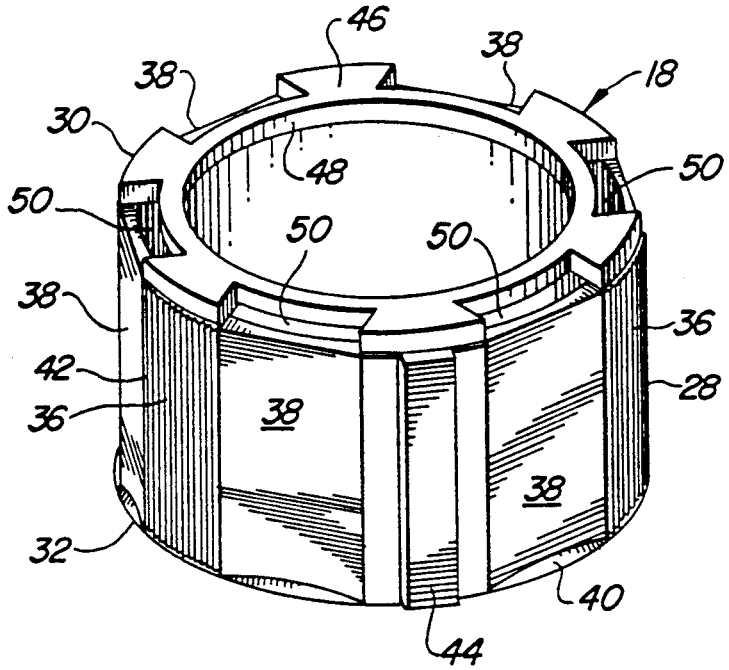
Fig. 1
Fig. 2
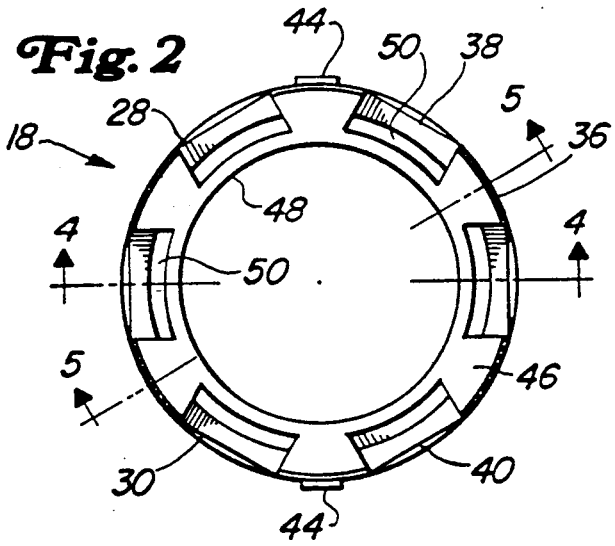
Fig. 3
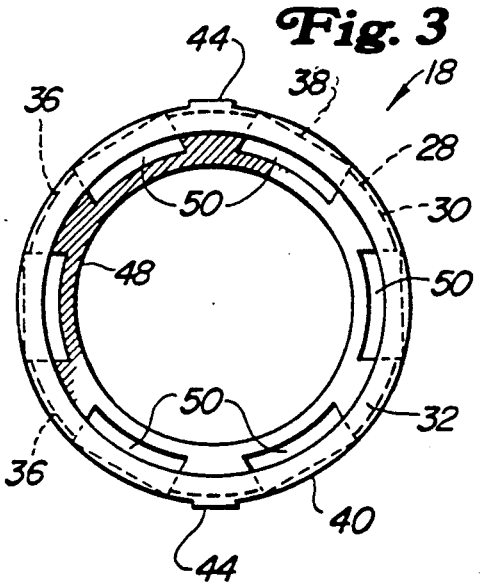
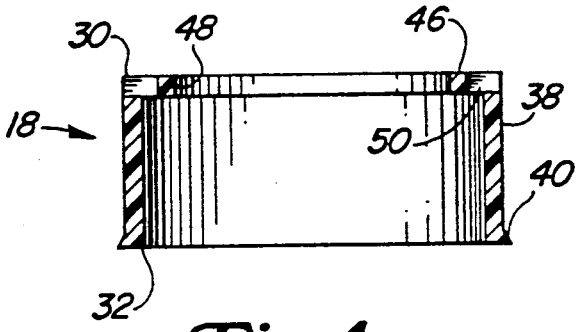
Fig. 4
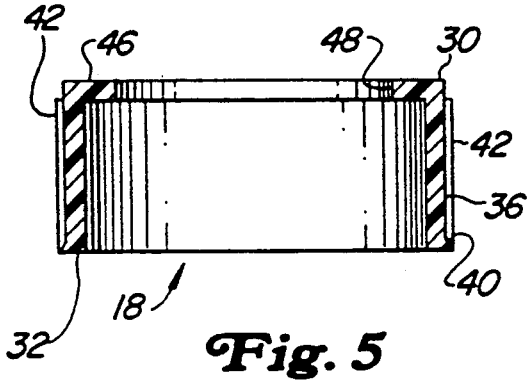
Fig. 5

FLEXIBLE CAP LINER

BACKGROUND AND SUMMARY OF THE INVENTION

In the field of relatively small containers such as used in the toiletries art, for example, it is frequently found that discrepancies in manufacture lead to improper fit between the container neck and the cavity of the closure or cap. Among such discrepancies are contour irregularities, eccentricity and the like, resulting in leakage from the container, improper fit of the cap on the neck, difficulty in removing and replacing the cap on the container, etc.

According to the present invention, the foregoing and other problems are eliminated by providing a cap liner of flexible, distortable material comprising a one-piece member having an annular wall dimensioned to fit within the cap so as to accommodate the irregularities by means of its flexibility. The material of which the liner is composed may be any of several known plastics, such as polyolfins or the like. The annular wall of the liner includes angularly alternated wall portions of different radial cross-sections or configurations, certain portions being, for example, of greater thickness than neighboring portions, the latter imparting greater flexibility to the liner. Further, the upper edge of the wall terminates in an annular flange projecting radially inwardly from the wall and itself affording a coaxial circular opening. The flange imparts a degree of rigidity to the upper part of the liner in certain respects, but reduction in weight as well as flexible attributes flow from the provision in the flange of a plurality of apertures, preferably slots of arcuate configuration.

The liner is capable of being mass-produced at relatively low cost and is further characterized by durability as well as improving the container-to-cap relationship.

Further features, objects and advantages of the invention will become apparent as the disclosure progresses.

DESCRIPTION OF THE DRAWINGS

FIG. 1 is a perspective of the liner.

FIG. 2 is a top view of the liner.

FIG. 3 is a bottom view of the liner.

FIG. 4 is a section on the line 4—4 of FIG. 2.

FIG. 5 is a section on the line 5—5 of FIG. 3.

DETAILED DESCRIPTION OF A PREFERRED EMBODIMENT OF THE INVENTION

Figure 6:
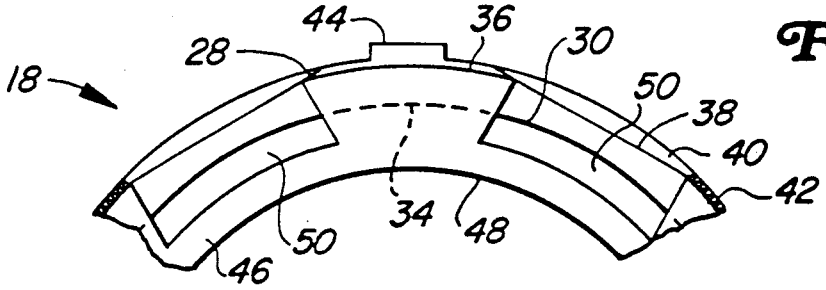
FIG. 6 is an enlarged fragmentary top view of the liner, showing in greater detail the relationship among certain components of the structure.
Figure 7:
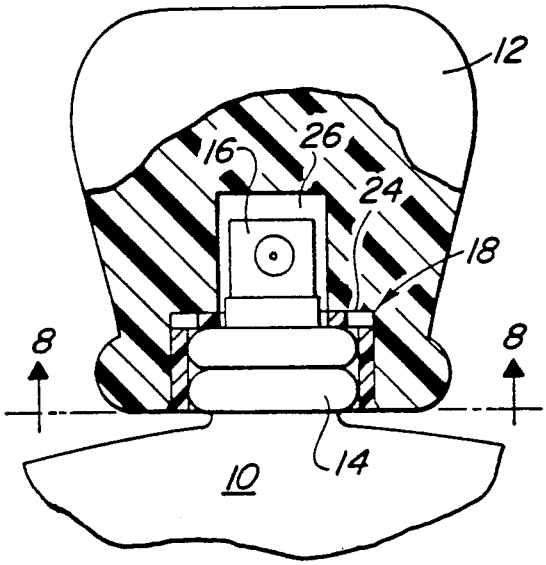
FIG. 7 is a fragmentary view, partly in section, showing a representative relationship between a container, cap and cap liner.
Figure 8:
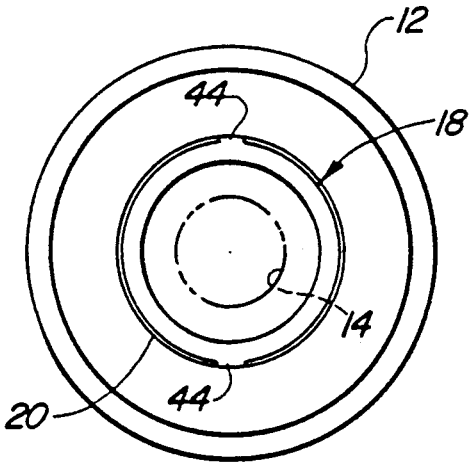
FIG. 8 is an enlarged section on the line 8—8 of FIG. 7.
Figure 9:
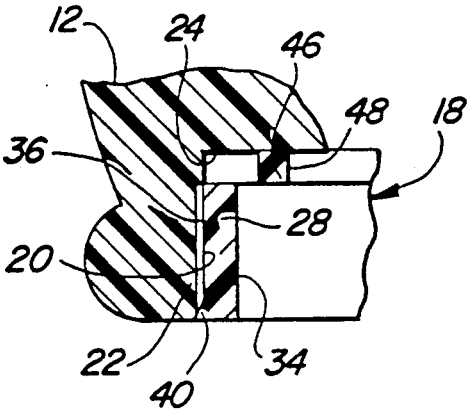
FIG. 9 is an enlarged section showing the fit between the cap and part of the liner.

Reference will be had first to FIG. 7 for an overview of what is involved in the relationship between a container 10 and a closure cap 12. The container is shown here by way of illustration as being of the type having neck means including a metal or equivalent collar 14 through which a pump 16 projects upwardly for dispensing the contents of the container by spraying, a background situation that exists in many forms in the toiletries field. Since the cap must be removed by the user in order to gain access to the pump, it is obvious that the separable connection between the cap and collar must be simple and durable, meaning that the fit between the cap and collar must be relatively close so that cap cannot be easily dislodged and lost. To solve these and related problems, the invention provides a flexible cap liner designated in its entirety at 18 and shown basically in FIGS. 1-6 as well as environmentally in FIGS. 7, 8 and 9. Before embarking on the details of the liner, reference will be first had to the cap's inclusion of an interior, essentially cylindrical cavity 20 having an interior annular wall 22 and a top or roof 24 plus an upward chamber 26 to accommodate the pump 16. When the cap is removed, the liner 18 stays with it and the pump 16 and collar 14 are exposed, it being noted that the collar is crimped on or otherwise has a force fit with the container so as to retain the pump 16 inplace.

The liner appearing in FIGS. 1 through 5 is a little over twice actual size. Just by way of example and without limiting the invention, a typical liner according to the invention will have an outside diameter on the order of one inch and an altitude of about one-half inch, with other components dimensioned accordingly. The liner is of one-piece preferably molded construction and has a cylindrical or annular wall 28 about an upright axis and provided with upper and lower edges 30 and 32, respectively. The wall has an annular inner or interior surface 34, here smooth or unthreaded, since it must fit frictionally with the collar 14 on the container 10. The outer surface of the wall 28 is made up of angularly alternated wall portions of different cathartics; that is, wall portions 36 of uniform thickness greater than the reduced thickness of interspaced wall portions 38. Stated otherwise, the wall portions 36 constitute ribs respectively having outer surfaces formed as arcs lying on a common cylinder about the upright axis of the liner. The wall portions 38 are flat, each in a plane including a chord of the circle or cylinder on which the rib surfaces lie. The alternated portions may be provided in any suitable manner following the example given here. The lower edge of the wall may include a circular skirt 40. The outer surfaces of some of the ribs are roughened or otherwise provided with means 42 for frictionally engaging the inner surface of the cap cavity. Each of diametrically opposed ribs includes a key 44 for cooperation with a key way (not shown) in the cap.

The upper edge of the wall terminates in an annular flange or rim 46 integral of course with the liner wall and projecting radially inwardly and having a circular inner edge defining a circular opening coaxial with the liner wall. Although the flange adds rigidity to the upper part of the liner where it fits the roof of the cap, flexibility is still afforded by the provision of a plurality of angularly spaced apart through apertures 50. These are preferably in radial alinement, respectively, with the flat wall portions 38 and also extend laterally outwardly and diminish the height of the flat portions 38. That is, each aperture or slot opens vertically as well as radially, further increasing the flexibility of the liner.

It will be clear from the foregoing that the liner is flexible and distortable and capable of recovering its shape. The flexibility of the liner enables it to accommodate irregularities in the cap and neck portion (collar 14) of the container. Features and advantages of the invention other than those pointed out will become apparent to those skilled in the art, all without departure from the spirit and scope of the invention.

I claim:

1. A one-piece liner of flexible, distortable material for use within a container cap, comprising an annular wall formed about an upright axis and having axially spaced apart upper and lower edges and inner and outer surfaces, characterized in that the wall has wall portions of a reduced radial thickness at angularly spaced intervals interspaced among wall portions of a greater radial thickness whereby the portions of reduced thickness impart greater flexibility to the liner.

2. A one piece cap liner according to claim 1 in which the wall portions of greater thickness are ribs extending between the upper and lower edges of the wall.

3. A one piece cap liner according to claim 2, in which the ribs respectively have arcuate outer surfaces lying on a cylinder about the axis of the wall.

4. A one piece cap liner according to claim 3, in which the outer surface of at least one rib includes a position adapted to frictionally engage the cylindrical interior of a cap.

5. A one piece cap liner according to claim 3, in which the outer surface of at least one rib includes a vertical key adapted to fit a key-way in a cap.

6. A one piece cap liner according to claim 3, in which each wall portion of reduced thickness has an outer flat surface lying in a plane including a chord of the cylinder that includes the arcuate outer surfaces of the ribs.

7. A one piece cap liner according to claim 1, in which the upper edge of the wall terminates in a substantially circular flange concentric with said upper edge and extending radially inwardly and normal to the wall and providing an interior, coaxial, circular opening of lesser diameter than the interior surface of the wall.

8. A one piece cap liner according to claim 7, in which the flange has a plurality of through apertures therein radially inwardly of the inner surface of the wall.

9. A one piece cap liner according to claim 8, wherein the apertures open radially to the wall as well as vertically to the interior of the liner.

10. A one piece cap liner according to claim 8, wherein the apertures are angularly spaced apart arcuate slots concentric with the wall.

11. A one piece cap liner according to claim 10, wherein each slot is substantially radially aligned with a wall portion of reduced thickness.

12. A one-piece liner of flexible, distortable material for use within a container cap, comprising an annular wall formed about an upright axis and having axially spaced apart upper and lower edges and inner and outer surfaces, characterized in that the wall has angularly alternated wall portions including first portions respectively having arcuate outer surfaces lying on a cylinder about the wall axis and second wall portions spaced radially inwardly of said cylinder.

* * * * *